US006513600B2

(12) United States Patent
Ross

(10) Patent No.: US 6,513,600 B2
(45) Date of Patent: Feb. 4, 2003

(54) APPARATUS AND METHOD FOR PACKING OR ANCHORING AN INNER TUBULAR WITHIN A CASING

(76) Inventor: Richard Ross, 5910 Foresthaven, Houston, TX (US) 77066

( * ) Notice: Subject to any disclaimer, the term of this patent is extended or adjusted under 35 U.S.C. 154(b) by 0 days.

(21) Appl. No.: 09/746,406

(22) Filed: Dec. 21, 2000

(65) Prior Publication Data

US 2002/0014339 A1 Feb. 7, 2002

Related U.S. Application Data

(60) Provisional application No. 60/171,359, filed on Dec. 22, 1999.

(51) Int. Cl.[7] ..... E21B 33/128; E21B 33/129; E21B 33/1295

(52) U.S. Cl. ..... 166/387; 166/120; 166/212; 277/334

(58) Field of Search ..... 166/387, 120, 166/196, 212; 92/53, 91; 277/334, 331; 285/351, 370

(56) References Cited

U.S. PATENT DOCUMENTS 3,374,838 A * 3/1968 Current ..... 166/123
3,631,927 A * 1/1972 Young ..... 166/125
4,204,690 A * 5/1980 Holland et al. ..... 277/336
4,302,018 A * 11/1981 Harvey et al. ..... 277/322
4,324,407 A * 4/1982 Upham et al. ..... 277/336
4,457,369 A * 7/1984 Henderson ..... 166/125
5,211,226 A * 5/1993 Hendrickson et al. ..... 166/118
5,494,106 A * 2/1996 Gueguen et al. ..... 166/277
5,511,620 A * 4/1996 Baugh et al. ..... 166/191
5,988,276 A * 11/1999 Oneal ..... 166/118
6,009,951 A * 1/2000 Coronado et al. ..... 166/127

* cited by examiner

*Primary Examiner*—David Bagnell
*Assistant Examiner*—Daniel P Stephenson

(57) ABSTRACT

The present invention provides an apparatus and method for sealing and/or anchoring against the inside surface of an outer tubular. In one embodiment, a radially expandable sleeve has at least one radially expandable separate rings located there about. The at least one ring is capable of radical expansion without appreciable deformation of the at least one edge for improved engagement between the at least one edge and the inside surface of the outer tubular. In another embodiment, the present invention provides an inflatable metal to metal seal packer that is able to accommodate out of round casing.

31 Claims, 9 Drawing Sheets

APPARATUS AND METHOD FOR PACKING OR ANCHORING AN INNER TUBULAR WITHIN A CASING

RELATED APPLICATIONS

This application claims priority to Provisional Application Ser. No. 60/171,359 filed Dec. 22, 1999 in the name of Richard Ross as inventor.

TECHNICAL FIELD OF THE INVENTION

The present invention relates to packers and anchors used in oil and gas wells. In one aspect, the invention relates to radially expandable rings for use in a packer or anchor to achieve a metal to metal seal and/or anchor of an inner tubular within a casing, for example, a well bore casing. In another aspect, the present invention relates to a packer or anchor with a sleeve that can be radially expanded in response to pressure until it seals and/or anchors against the inside surface of the outer tubular, for example, a well bore casing.

BACKGROUND OF THE INVENTION

During the course of completing and producing an oil or gas well, the annulus between the well bore casing and an interior tubular, for example a work string or a production string, is commonly required to be sealed. One type of such an annular seal is referred to as a packer. Packers often employ elastomeric sealing rings that have a running diameter while tripped to the desired location in the well bore and then are expanded radially outward by some mechanism to seal against the inside of the well bore casing. Elastomeric seals suffer from several drawbacks. They often cannot withstand prolonged high temperature and/or high pressure. The seals may also extrude into gaps sacrificing the sealing quality. Additionally, elastomeric seals are susceptible to swabbing off of the packer when the packer is tripped down hole due to the fluid flow across the elastomeric seal.

U.S. Pat. No. 5,511,620 to Baugh discloses a packer that combines a metal to metal seal with a conventional elastomer seal. A metal cylinder with radially extending ridges is expanded radially outward until the metal ridges engage the inside of the well bore. This design suffers from at least three drawbacks. First, because the ridges are part of the cylinder, they must be made from the same relatively soft ductile material as the cylinder and therefore will not imbed sufficiently into the harder inside of the well bore casing. Secondly, as the cylinder expands, the ridges must deform plasticly as they likewise expand which dulls any sharp edge that may have been machined onto the ridges. Thirdly, the cylinder is expanded with a tapered piston that has a circular cross-section. As this tapered piston expands the cylinder radially outward, the cylinder may not conform to out-of-round well bore casing or a defect in the casing wall.

Therefore, a need exists for an expandable seal that can seal the annulus between the well bore casing and an inner tubular without the drawbacks of the metal to metal seal of the '620 patent or the conventional elastomeric seals. A need also exists for a packer metal to metal seal that can conform to out of round holes for proper sealing.

Additionally, the inner tubular may need to be anchored within the casing with or without sealing the annulus. Therefore, a need exists for a slip that can be employed alone or with metal to metal sealing of an inner tubular within a casing.

SUMMARY OF THE INVENTION

The present invention provides an expandable metal to metal seal and/or anchor that overcomes the above discussed deficiencies. In one embodiment of the present invention, a metal cylinder with separate rings is radially expanded by a fluid so that the cylinder will conform to the inside of the well bore casing and the rings expand as the waviness accommodates the expansion of the cylinder while the rings do not deform plasticly thereby retaining any sharp edges. For sealing, the rings are continuous and wavy in the axial direction while for solely anchoring, the rings can be split rings without any waviness in the axial direction.

In another embodiment, the present invention provides an inflatable cylinder that can conform to out of round casing and provide a metal to metal seal.

DETAILED DESCRIPTION OF THE PREFERRED EMBODIMENTS

Figure 1A:
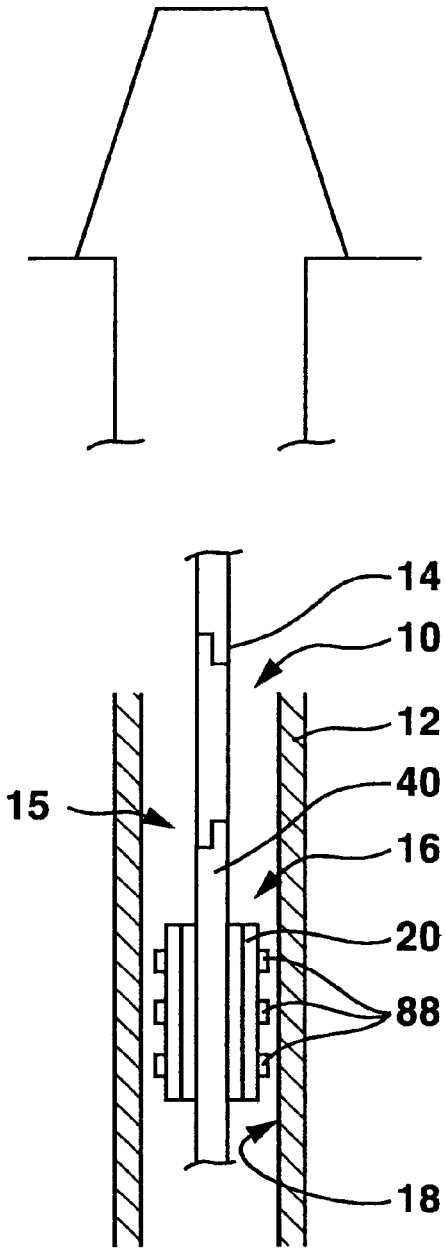
FIG. 1A is a schematic view of the present invention in the "running position"
Figure 1B:
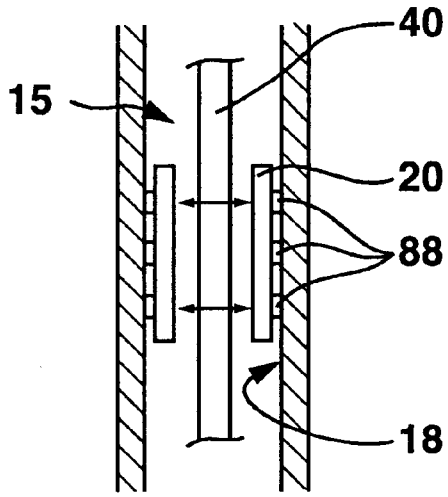
FIG. 1B is a schematic view of the present invention in the "set position"

With reference to FIGS. 1A–B, a schematic of the present invention is shown in the context of a well bore application. Well bore 10 has an outer tubular 12 therein which is shown by way of example as borehole casing. Pipe string 14 is tripped, or run, into well bore 10 in FIG. 1A and will typically have various subs and tools connected in line in the string for performing various tasks in the well which may require sealing of annulus 15 between pipe string 14 and outer tubular 12 and/or anchoring of pipe string 14 relative to outer tubular 12. The present invention provides apparatus 16 for such sealing and/or anchoring.

Apparatus 16 has mandrel 40 which is connected in line in pipe string 14 at the appropriate location relative to the various subs and tools. Disposed about mandrel 40 is radially expandable sleeve 20 with at least one radially expandable ring 88 disposed about sleeve 20. During running of pipe string 14 into outer tubular 12, apparatus 16 is in the "running position" which is shown in FIG. 1A. When apparatus 16 is at the desired depth in well bore 10, sleeve 20 is expanded radially outward until rings 88 are forced into inside surface 18 of outer tubular 12. This is the "set position" and is shown in FIG. 1B. Sleeve 20 may be radially expanded by various methods, two of which—inflation (see FIGS. 2–3) and tapered cylinder—will be discussed herein.

Figure 8:
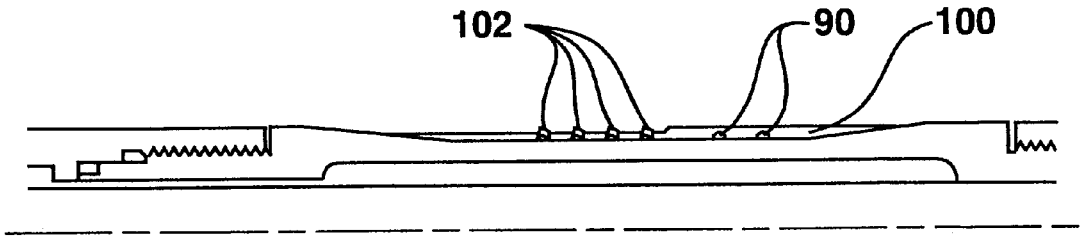
FIG. 8 is a quarter section of an alternative embodiment of the seal and ring assembly of the present invention with modified elastomeric material.
Figure 9:
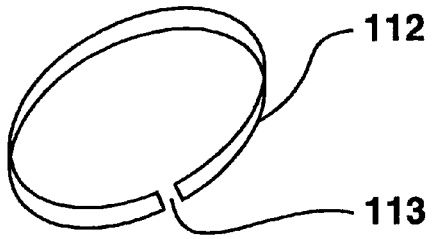
FIG. 9 is a perspective view of the preferred embodiment of the split ring of the present invention.
Figure 10:
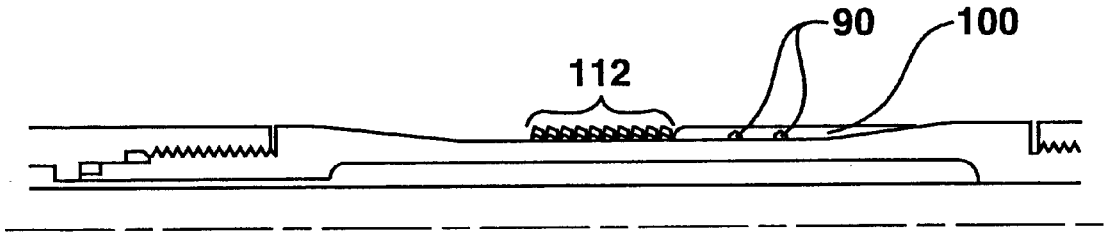
FIG. 10 is a quarter section of an alternative embodiment of the seal and ring assembly of the present invention with split rings and seal rings.
Figure 11:
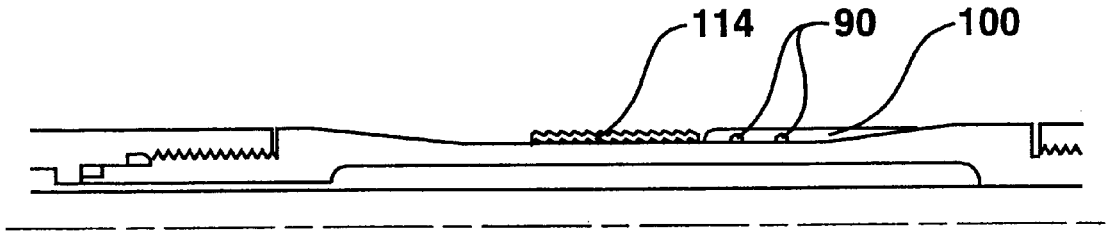
FIG. 11 is a quarter section view of an alternative embodiment of the seal and ring assembly of the present invention with a segmented ring and seal rings.

Rings 88 may comprise 1) at least one seal ring 90 (see FIGS. 3–5) for metal to metal sealing of the annulus, 2) at least one slip seal ring 102 (see FIGS. 6–8) for metal to metal sealing of the annulus and anchoring, and/or 3) at least one split ring 112 or segmented ring 114 for anchoring (see FIGS. 9–11). Rings 88 are distinct separate pieces from sleeve 20 so that one advantage of the present invention is the ability to readily tailor the amount and types of rings 88 for each particular application without having to modify sleeve 20 and the other components of apparatus 16.

Figure 2:
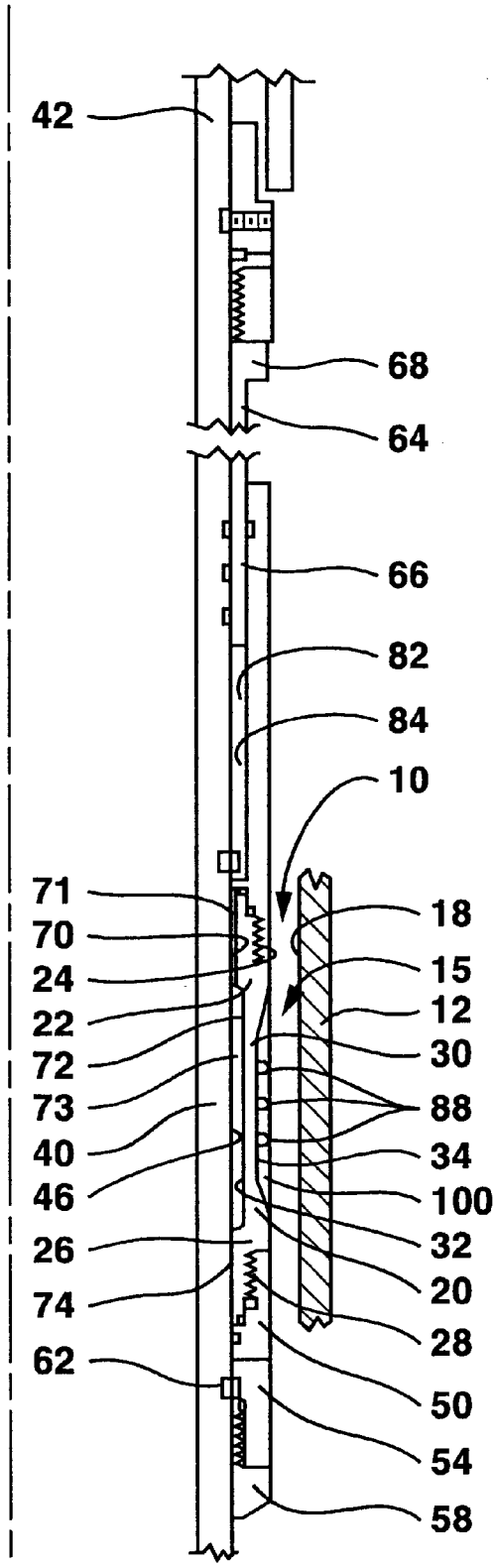
FIG. 2 is a longitudinal quarter section view of the preferred embodiment of the inflatable version of the apparatus of the present invention in the running position within an outer tubular.
Figure 3:
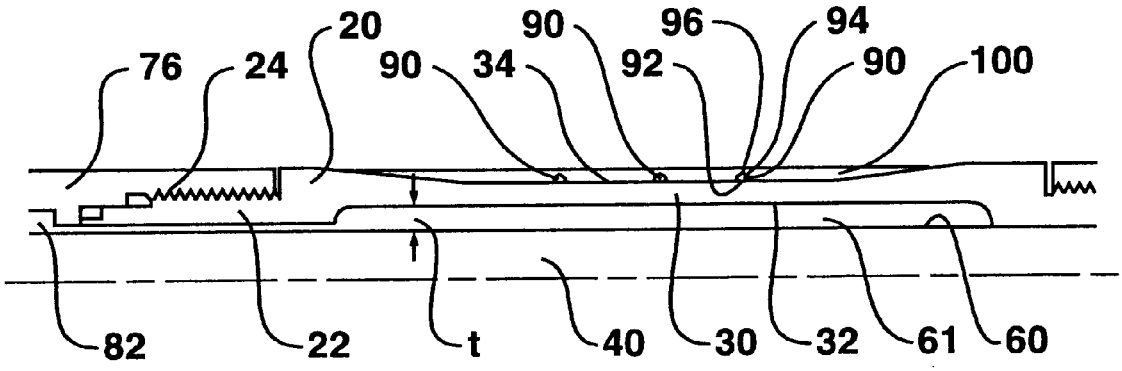
FIG. 3 is a close-up quarter section of the sleeve and ring assembly of FIG. 2.

With reference to FIGS. 2 and 3 the preferred embodiment of the apparatus 16 where sleeve 20 is expanded by inflation is shown. FIG. 2 shows apparatus 16 in its non-actuated, running position inside outer tubular 12. Outer tubular 12 has inside surface 18 which may be generally circular but also may be irregular to the extent of being oval, out of round and/or having surface irregularities. Outer tubular 12 can be the borehole casing or other tubular used in a borehole. Apparatus 16 has expandable sleeve 20 which has top end 22 with external threads 24 and bottom end 26 with external threads 28. Sleeve 20 has expandable portion 30 which is of a thickness and material such that portion 30 can be deformed to expand radially outward. Sleeve 20 has inside surface 32 and outside surface 34.

Sleeve 20 is disposed concentrically about mandrel 40 with upper end 42 and lower end 44 opposite thereto. Mandrel 40 has outer surface 46. Sleeve 20 is prevented from axially downward movement relative to mandrel 40 by virtue of retainer 50 threaded to threads 28 which is abutted atop stop ring 54 which is threaded to stop ring retainer 58 and axially locked to mandrel 40 by locking dog 62.

Inside surface 32 of sleeve 20 is a generally stepped cylindrical surface with first diameter 70 at top end 22 creating first annular passage 71 between sleeve 20 and mandrel 40 then stepping radially outward to second diameter 72 generally coextensive with expandable portion 30 creating second annular passage 73 and then stepping radially inward to third diameter 74 at bottom end 26. Second passage 73 is shown by example as chamber 60 with thickness t.

Chamber 60 can either be filled with a fluid, for example air, other gas, or liquid. Chamber 60 can also be filled with a material not normally considered a fluid but that will expand radially outward against expandable portion 30 in response to pressure through first passage 71, for example, rubber (e.g. 80 HD silicon rubber), nylon (Nylon type 6), Teflon, 60 HD Viton. These materials along with other materials like them and fluids will be considered "flowable" materials. As pressure within chamber 60 increases, its thickness t will want to increase and the least resistance to the pressure in chamber 60 is expandable portion 30 which will begin to deform and expand radially outward.

Pressure is preferably communicated to chamber 60 by piston 64 which is located about mandrel 40 with bottom end 66 and top end 68. Piston 64 is concentrically disposed between mandrel 40 and sleeve extension 76 which is threaded to top end 22 of sleeve 20 and radially spaced from mandrel 40 to define reservoir 82 underneath piston 64 at one end and in communication with first passage 71 at the other end. In the preferred embodiment, reservoir 82 is filled with flowable material 84 like that of flowable material 61 in chamber 60.

In operation, when apparatus 16 is located at the desired position in the borehole, piston 64 is moved axially downward either mechanically by imparting weight to piston 64 by setting of the pipe string or hydraulically by pressurizing the pipe string or annulus. As piston 64 moves axially downward, flowable material 84 flows begins to flow through first passage 71 and into chamber 60 increasing the pressure in chamber 80 until expandable portion 30 of sleeve 20 begins expanding radially outward.

Figure 4:
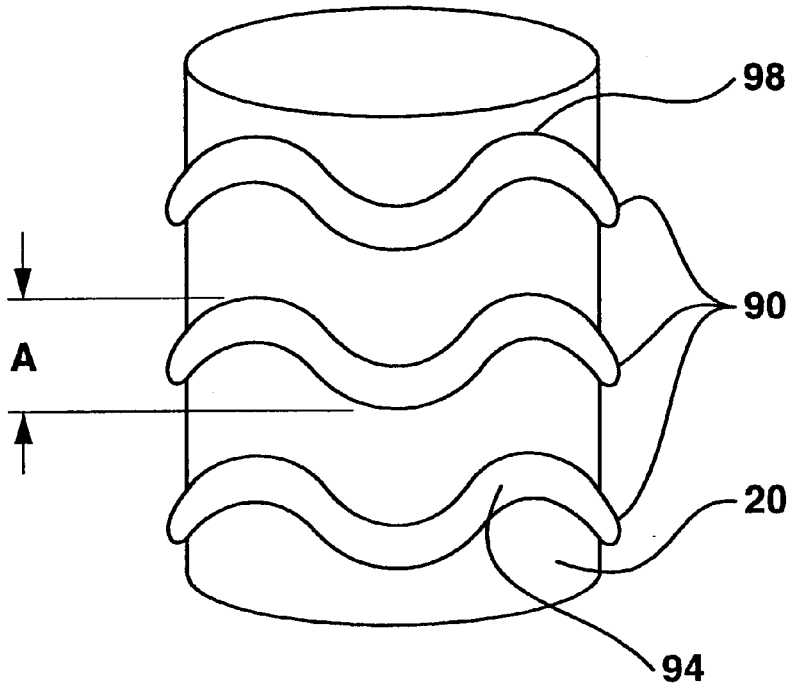
FIG. 4 is a perspective view of the sleeve and ring assembly from FIG. 3 with the elastomeric material removed.
Figure 5:
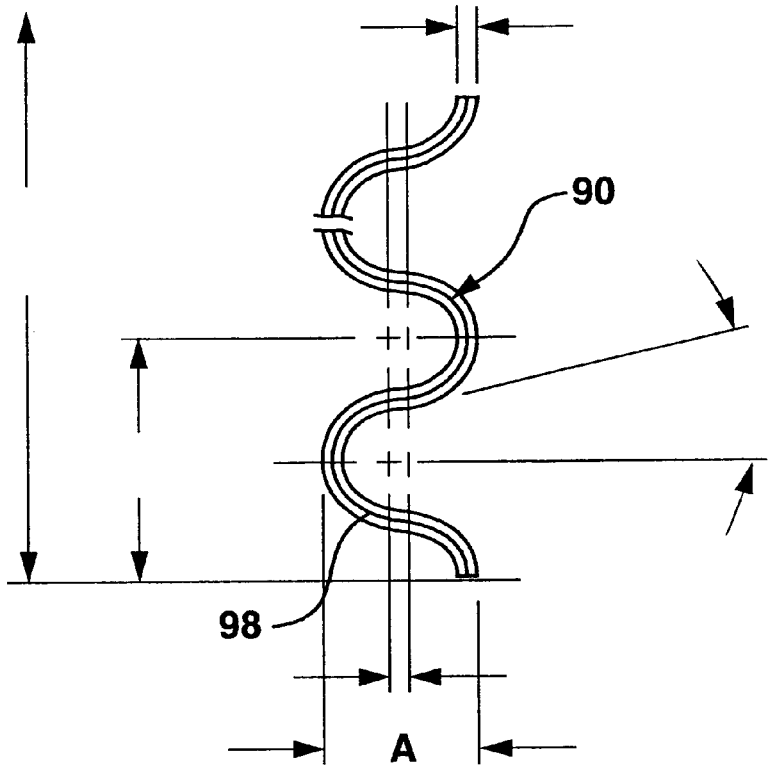
FIG. 5 is a laid out view of a portion of the preferred embodiment of the seal ring of FIG. 4.

At least one ring 88, shown by way of example as seal ring 90, is disposed about expandable portion 30. In this preferred embodiment of a metal to metal seal, three seal rings 90 are located about sleeve 20. Seal ring 90 has inner side 92 toward outside surface 34 of sleeve 20 and outer side 94 toward inside surface 18 of outer tubular 12. With further reference to FIGS. 4–5, ring 90 is shown in more detail. Ring 90 undulates, or is wavy, in the axial direction having an amplitude A in the axial direction. The undulation of ring 90 allows ring 90 to radially expand outward as expandable portion 30 expands outward. As ring 90 radially expands, amplitude A will decrease.

Ring 90 has outer edge 96 on outer side 94 that will bite into inside surface 18 of outer tubular 12 as ring 90 is expanded into contact with outer tubular 12. Because ring 90 is separate from sleeve 20 and has at least one axial undulation 98 to allow for expansion, outer edge 96 will not dull as ring 90 is expanded. At least one undulation 98 allows for radial expansion of ring 90 without appreciable material deformation of outer edge 96. The material of ring 90, or at least of outer edge 96, is preferably harder than inside surface 18 of outer tubular 12 so that outer edge will set into inside surface 18 sufficiently to create a metal to metal seal. Similarly, inner side 92 is preferably harder than expandable portion 30 so that inner side 92 will set into outside surface 34 sufficiently to create a metal to metal seal.

Preferably, elastomeric material 100 is used in conjunction with seal ring 90 to enhance sealing. Elastomeric material 100 is disposed about expandable portion 30 and in between seal rings 90. Elastomeric material may or may not extend over outer edges 96 of rings 90.

Figure 6:
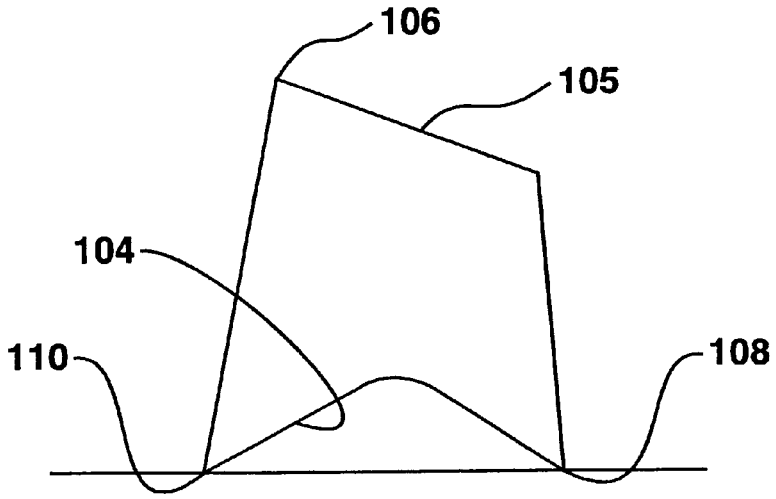
FIG. 6 is a cross-section of the preferred embodiment of the slip seal ring for use with the present invention.
Figure 7:
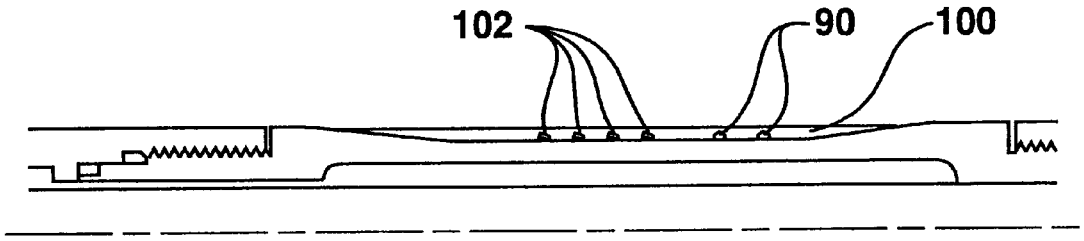
FIG. 7 is a quarter section of an alternative embodiment of the seal and ring assembly of the present invention with seal rings and slip seal rings.

It may be desired that apparatus 16 additionally act as a slip to anchor to inside surface 18 of outer tubular 12. With reference to FIGS. 6 and 7, the cross-section of slip seal ring 102 is shown that can be used in addition to seal rings 90 or in place of seal rings 90 to function as a slip as well as provide a metal to metal seal. Slip seal ring 102 has inner side 104 which has second edge 108 and third edge 110 that will bite into outside surface 34 of expandable portion 30. In conjunction with first edge 106 of outer side 105 that bites into inside surface 18 of outer tubular 12, slip seal rings 102 acts as a slip to anchor apparatus 16 into outer tubular 12.

Slip seal rings 102 may be used alone or with rings 90 as shown in FIG. 6. Slip seal rings 102 may have only one edge on the inner side or more than two. Slip seal rings 102 are preferably undulated similarly to seal rings 90. Elastomeric material 100 may have a varying thickness to cover some rings but leave edges of other rings exposed as shown in FIG. 8.

With reference to FIGS. 9–10, the preferred embodiment of split rings 112 is shown. Split rings have a cross-section similar to slip seal rings 102 but are split at split 113 such that they are "C" shaped rings without any undulations. Without the undulations, split rings 112 can be stacked in closer proximity along expandable portion 30 yet can still expand radially outward by virtue of being split. Split rings 112 may not seal adequately due to the split, but if sealing is desired, at least one seal ring 90 or slip seal ring 102 can be used in combination with split rings 112. Split rings 112 have useful application where the slip forces encountered will be high and several rings are needed to anchor, the split ring configuration allows grouping of a large number of rings together as shown in FIG. 10.

FIG. 11 shows yet another alternative embodiment of ring 88 depicted as segmented ring 114 with segments that separate or break apart upon radial expansion and bite into outside surface 34 of expandable portion 30 and inside surface 18 of outer tubular 12 to anchor apparatus 16 in outer tubular 12.

Figure 12:
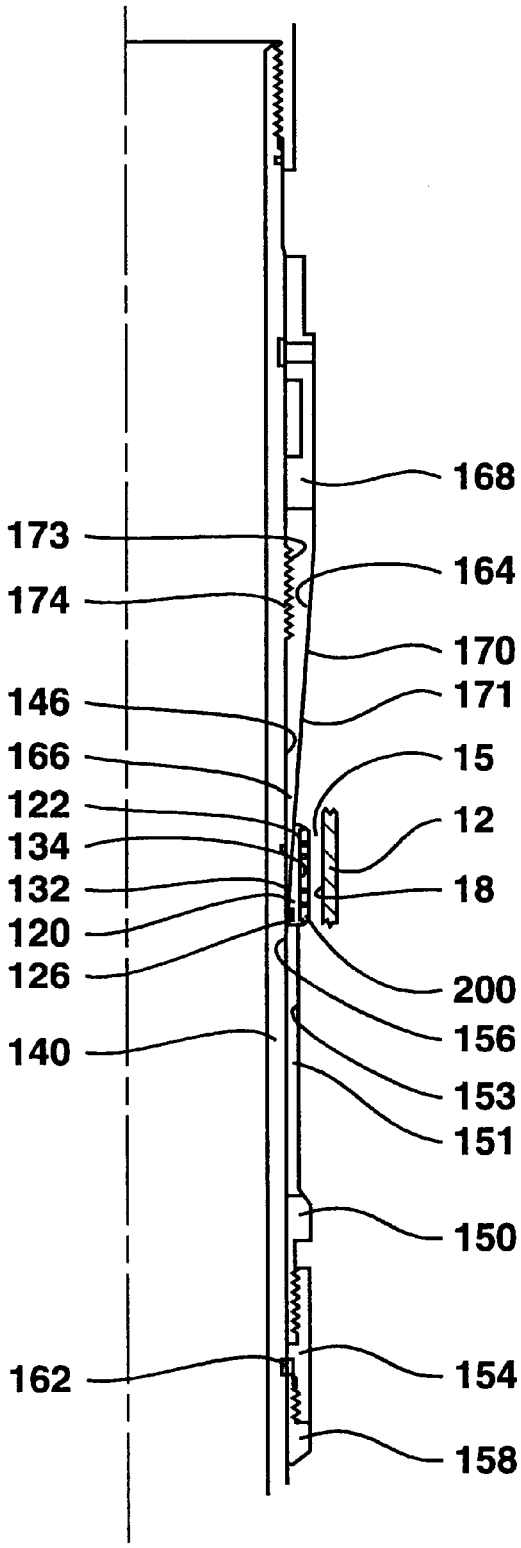
FIG. 12 is a longitudinal quarter section of the preferred embodiment of the tapered cylinder version of the apparatus of the present invention in the running position within an outer tubular.
Figure 13:
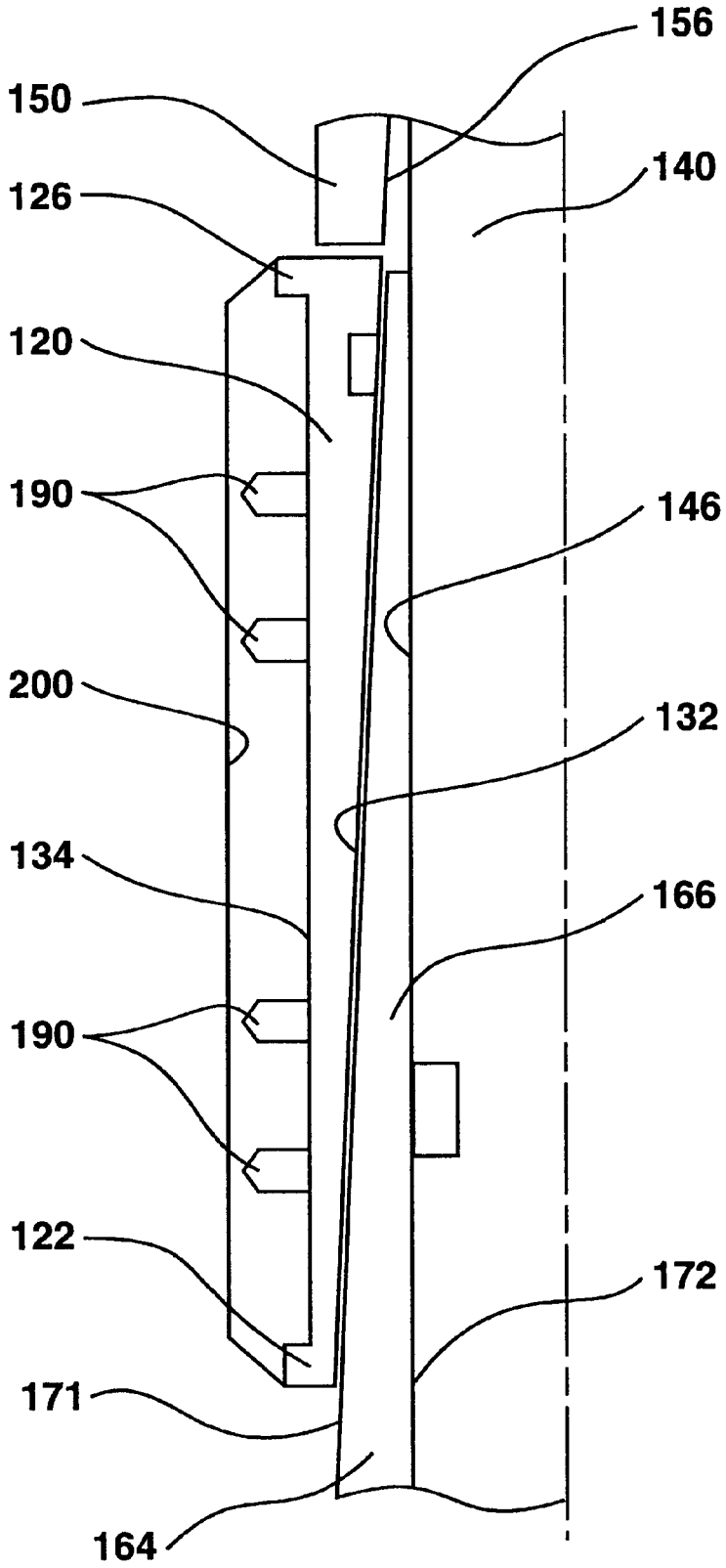
FIG. 13 is a close up quarter section of the sleeve and ring assembly of FIG. 12.

While ring 88 has been shown in the various embodiments of rings 90, 102, 112 and 114 on sleeves 20 of the inflatable type, rings 90, 102, 112 and 114 can also be used on sleeves 120 that are expanded radially by a tapered cylinder as shown in FIGS. 12 and 13. The inflatable embodiment is preferred because it has the advantage that sleeve 20 will better conform to out of round tubulars or imperfections on the inside surface of the outer tubular. However, rings 88 may be used with the tapered cylinder embodiment.

With reference to FIGS. 12 and 13 the tapered cylinder embodiment of the present invention is shown. FIGS. 12 and 13 shows apparatus 116 in the running position inside outer tubular 12. Apparatus 116 has sleeve 120 located about tapered cylinder 164 which is located about mandrel 140. Sleeve 120 has top end 122 and bottom end 126 opposite thereto. Sleeve 120 has tapered inside surface 132 that slopes radially inward from top end 122 to bottom end 126. Sleeve 120 has outside surface 134 that is generally cylindrical with at least one ring 190 disposed there about.

With reference to FIGS. 12A–B and 13A–B, the tapered cylinder embodiment of the present invention is shown. FIGS. 12A and 13A shows apparatus 116 in the running position inside outer tubular 12. Apparatus 116 has sleeve 120 located about tapered cylinder 164 which is located about mandrel 140. Sleeve 120 has top end 122 and bottom end 126 opposite thereto. Sleeve 120 has tapered inside surface 132 that slopes radially inward from top end 122 to bottom end 126. Sleeve 120 has outside surface 134 that is generally cylindrical with at least one ring 190 disposed there about.

Sleeve 120 is disposed on retainer 150 that is threaded to stop ring 154 which is threaded to stop ring retainer 58. Locking dog 162 is located axially between stop ring 54 and stop ring retainer 158 and extends radially into mandrel 140 to prevent axial movement of retainer 150.

Figure 14:
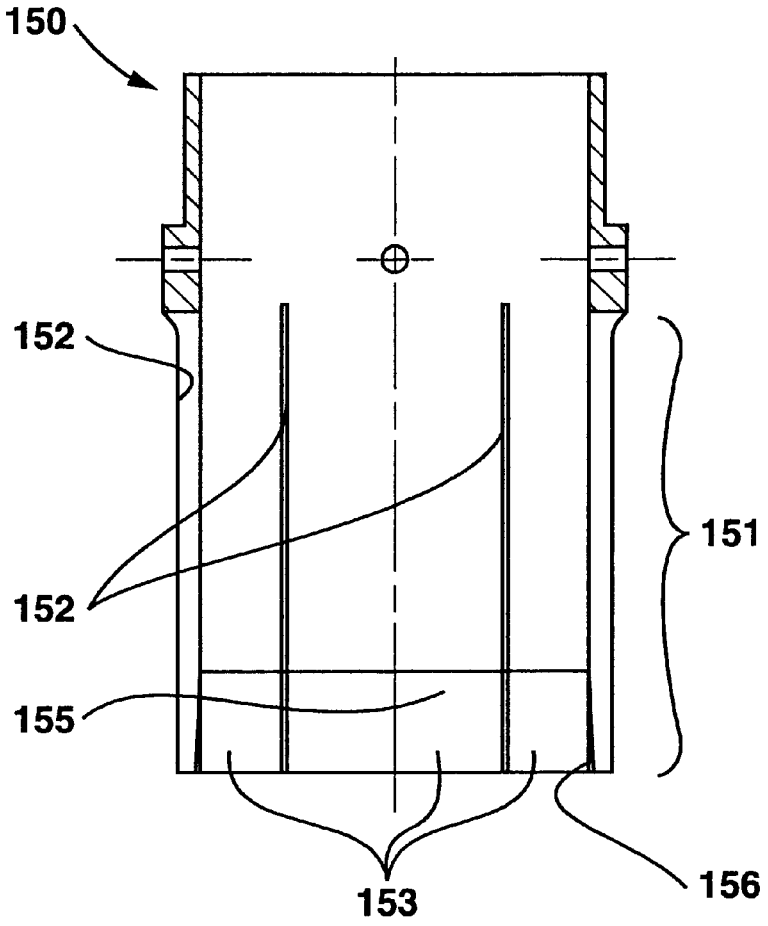
FIG. 14 is cross sectional view of the retainer of the apparatus of FIG. 12.
Figure 15:
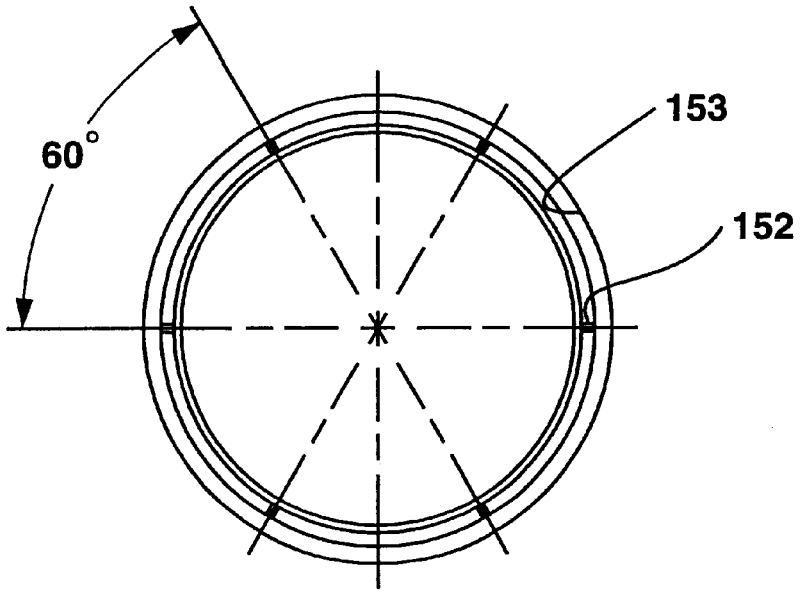
FIG. 15 is a top view of the retainer of FIG. 14.

With further reference to FIGS. 14–15, retainer 150 has top portion 151 which is generally cylindrical with axial extending cuts 152 spaced 60 degrees apart to divide top portion 151 into six sectors 153. Each sector has top end 155 with taper 156 formed thereon. Cuts 152 in combination with tapers 156 allow for radial deflection of sectors 153 when tapered cylinder 164 is driven downward.

Tapered cylinder 164 has bottom end 166 located between sleeve 120 and mandrel 140 and top end 168 opposite thereto. Tapered cylinder 164 has outside surface 170 that defines taper 171 tapering radially inward as it proceeds downward. In the preferred embodiment, the taper is preferably about 3 degrees. Tapered cylinder 164 has inside surface 172 that is generally cylindrical and slidably disposed about outer surface 146 of mandrel 140. Outer surface 146 of mandrel 140 defines ratchet portion 173 that corresponds with ratchet portion 174 defined on inside surface 172 of tapered cylinder 164. Ratchet portions 173, 174 allow only for axial downward movement of tapered cylinder 164 relative to mandrel 140.

In operation, when apparatus 116 is located at the desired position in the borehole, tapered cylinder 164 is moved axially downward either mechanically by imparting weight to top end 168 of tapered cylinder 164 by setting of the pipe string or hydraulically by pressurizing the pipe string or annulus. As tapered cylinder 164 moves axially downward, taper 171 of bottom end 166 of tapered cylinder 164 is forced along opposing taper of inside surface 132 of sleeve 120 which caused sleeve 120 to expand radially outward until rings 190 sufficiently engage inside surface 18 of outer tubular 12. As a portion of taper 171 of tapered cylinder 164 passes below sleeve 120, sectors 153 of retainer 150 deflect radially outward to accommodate taper 171. Ratchet portions 173, 174 maintain apparatus 116 in the set position.

While the present invention has been described according to preferred embodiments, it will be understood that modifications can be made from the foregoing description without departing from the scope of the invention as claimed.

What is claimed is:

1. An apparatus for sealing and/or anchoring against the inside surface of an outer tubular in a well bore, the apparatus comprising:

(a) a metal sleeve dimensioned to be run into the outer tubular in a running position and having a radially expandable portion;

(b) at least one separate ring disposed concentrically about the radially expandable portion of the cylinder, the ring expandable radially outward such that the radially expandable portion and the at least one ring can be radially expanded together until the at least one ring contacts the inside surface of the outer tubular without appreciable material deformation of the at least one ring; and (c) an elastomeric material disposed around at least the radially expandable portion of the sleeve and over or adjacent to the at least one ring.

2. The apparatus of claim 1 wherein the at least one ring comprises at least one seal ring that is a continuous ring that has at least one undulation in the axial direction such that radial expansion of the seal ring flattens the at least one undulation of the ring in the axial direction.

3. The apparatus of claim 2 wherein the at least one ring further comprises at least one slip ring that is a split ring to allow radial expansion of the at least one slip ring.

4. The apparatus of claim 1 wherein the at least one ring comprises at least one slip ring that is a split ring to allow radial expansion of the at least one slip ring.

5. The apparatus of claim 1 wherein the at least one ring comprises at least one slip ring has an inner side with at least one edge that engages the outer surface of the expandable portion of the sleeve when the sleeve is expanded to the set position and an outer side with at least one edge that engages the inside surface of the outer tubular.

6. The apparatus of claim 5 wherein the at least one slip ring is continuous and has at least one undulation in the axial direction that will flatten upon radial expansion of the ring.

7. The apparatus of claim 5 wherein the at least one slip ring is split to allow radial expansion of the ring.

8. The apparatus of claim 1 wherein the at least one ring is metal.

9. The apparatus of claim 1 wherein the at least one ring is continuous with at least one undulation in the axial direction and further comprising an at least one split ring.

10. The apparatus of claim 1 further comprising a mandrel about which the sleeve is concentrically disposed, the sleeve inflatable radially outward in response to a predetermined level of pressurization between the mandrel and the sleeve.

11. The apparatus of claim 10 wherein the sleeve has an inside surface spaced from the mandrel defining a chamber between the mandrel and the expandable portion of the sleeve, the chamber having a flowable material therein.

12. The apparatus of claim 11 wherein the flowable material is selected from the group consisting of rubber, polymers, oil, water and epoxy.

13. An apparatus for sealing and/or anchoring against the inside surface of an outer tubular in a well bore, the apparatus comprising:

(a) a metal sleeve dimensioned to be run into the outer tubular in a running position and having a radially expandable portion;

(b) at least one separate ring disposed concentrically about the radially expandable portion of the cylinder, the ring expandable radially outward such that the radially expandable portion and the at least one ring can be radially expanded together until the at least one ring contacts the inside surface of the outer tubular without appreciable material deformation of the at least one ring; and (c) wherein the at least one ring is wavy in the axial direction to create a plurality of the undulations.

14. The apparatus of claim 13 wherein the cross-section of the ring is generally constant.

15. An apparatus for sealing and/or anchoring against the inside surface of an outer tubular in a well bore, the apparatus comprising:

(a) a metal sleeve dimensioned to be run into the outer tubular in a running position and having a radially expandable portion;

(b) at least one separate ring disposed concentrically about the radially expandable portion of the cylinder, the ring expandable radially outward such that the radially expandable portion and the at least one ring can be radially expanded together until the at least one ring contacts the inside surface of the outer tubular without appreciable material deformation of the at least one ring, wherein the at least one ring comprises at least one seal ring that is a continuous ring that has at least one undulation in the axial direction such that radial expansion of the seal ring flattens the at least one undulation of the ring in the axial direction, and wherein the at least one ring further comprises at least one segmented ring that has circular zones of weakness such that upon radial expansion of the ring, at least some of the segments will at least partially fracture from another segment.

16. An apparatus for sealing and/or anchoring against the inside surface of an outer tubular in a well bore, the apparatus comprising:

(a) a metal sleeve dimensioned to be run into the outer tubular in a running position and having a radially expandable portion;

(b) at least one separate ring disposed concentrically about the radially expandable portion of the cylinder, the ring expandable radially outward such that the radially expandable portion and the at least one ring can be radially expanded together until the at least one ring contacts the inside surface of the outer tubular without appreciable material deformation of the at least one ring, and wherein the at least one ring is segmented such that upon radial expansion of the ring, at least some of the segments will at least partially fracture from another segment.

17. An apparatus for sealing and/or anchoring against the inside surface of an outer tubular in a well bore, the apparatus comprising:

(a) a metal sleeve dimensioned to be run into the outer tubular in a running position and having a radially expandable portion;

(b) at least one separate ring disposed concentrically about the radially expandable portion of the cylinder, the ring expandable radially outward such that the radially expandable portion and the at least one ring can be radially expanded together until the at least one ring contacts the inside surface of the outer tubular without appreciable material deformation of the at least one ring, and wherein the at least one ring is made of a material harder than the material of the sleeve.

18. An apparatus for sealing and/or anchoring against the inside surface of an outer tubular in a well bore, the apparatus comprising:

(a) a metal sleeve dimensioned to be run into the outer tubular in a running position and having a radially expandable portion;

(b) at least one separate ring disposed concentrically about the radially expandable portion of the cylinder, the ring expandable radially outward such that the radially expandable portion and the at least one ring can be radially expanded together until the at least one ring contacts the inside surface of the outer tubular without appreciable material deformation of the at least one ring; and (c) an elastomeric material disposed around at least the radially expandable portion of the sleeve with the at least one edge of the at least one ring exposed through the elastomeric material.

19. An apparatus for sealing and/or anchoring against the inside surface of an outer tubular in a well bore, the apparatus comprising:

(a) a metal sleeve dimensioned to be run into the outer tubular in a running position and having a radially expandable portion;

(b) at least one separate ring disposed concentrically about the radially expandable portion of the cylinder, the ring expandable radially outward such that the radially expandable portion and the at least one ring can be radially expanded together until the at least one ring contacts the inside surface of the outer tubular without appreciable material deformation of the at least one ring, (c) a mandrel about which the sleeve is concentrically disposed, the sleeve inflatable radially outward in response to a predetermined level of pressurization between the mandrel and the sleeve, wherein the sleeve has an inside surface spaced from the mandrel defining a chamber between the mandrel and the expandable portion of the sleeve, the chamber having a flowable material therein, and (d) a piston slidably disposed about the mandrel and located about the chamber with a bottom end disposed in a reservoir in communication with the chamber, the piston slidable to increase the pressure in the chamber sufficiently to radially expand the expandable portion of the sleeve to the set position.

20. An apparatus for sealing and/or anchoring against the inside surface of an outer tubular in a well bore, the apparatus comprising:

(a) a metal sleeve dimensioned to be run into the outer tubular in a running position and having a radially expandable portion;

(b) at least one separate ring disposed concentrically about the radially expandable portion of the cylinder, the ring expandable radially outward such that the radially expandable portion and the at least one ring can be radially expanded together until the at least one ring contacts the inside surface of the outer tubular without appreciable material deformation of the at least one ring; and (c) a mandrel about which the sleeve is located, the sleeve having an inside surface tapering radially inward from top end to a bottom end, and further comprising a tapered cylinder with a tapered bottom end located between the mandrel and the inside surface of the sleeve such that downward movement of the tapered cylinder will radially expand the radially expandable portion of the sleeve.

21. The apparatus of claim 20 further comprising a retainer fixed axially relative to the mandrel and positioned beneath the sleeve to prevent downward movement of the sleeve.

22. The apparatus of claim 21 wherein the retainer has a top portion that is axially cut into at least two sectors such that the sectors will deflect radially outward as the tapered bottom of the tapered cylinder pass beyond the sleeve and in between the mandrel and the retainer.

23. A method of anchoring and/or sealing against an inside surface of an outer tubular in a well bore, the method comprising the steps of:

(a) running a mandrel with a sleeve thereon into the outer tubular to a desired location, the sleeve having a radially expandable portion with at least one separate ring generally concentrically disposed about the radially expandable portion and an elastomeric material disposed around at least the radially expandable portion of the sleeve and over or adjacent to the at least one ring;

(b) radially expanding the radially expandable portion of the sleeve whereby the at least one ring radially expands without appreciable deformation until the at least one ring engages the inside surface of the outer tubular to seal and/or anchor against the inside surface of the outer tubular.

24. The method of claim 23 wherein the step of radially expanding the radially expandable portion of the sleeve comprises the step of pressurizing a chamber located between the mandrel and the sleeve until the radially expandable portion of the sleeve expands until the at least one edge of the at least one ring engages the inside surface of the outer tubular.

25. The method of claim 23 wherein the at least one ring comprises a seal ring that is continuous with at least one undulation in the axial direction that flattens upon radial expansion of the ring.

26. The method of claim 23 wherein the at least one ring comprises a slip ring that engages the inside surface of the outer tubular upon radial expansion to anchor the sleeve relative to the outer tubular.

27. A method of anchoring and/or sealing against an inside surface of an outer tubular in a well bore, the method comprising the steps of:

(a) running a mandrel with a sleeve thereon into the outer tubular to a desired location, the sleeve having a radially expandable portion with at least one separate ring generally concentrically disposed about the radially expandable portion;

(b) radially expanding the radially expandable portion of the sleeve whereby the at least one ring radially expands without appreciable deformation until the at least one ring engages the inside surface of the outer tubular to seal and/or anchor against the inside surface of the outer tubular, wherein the step of radially expanding the radially expandable portion of the sleeve comprises the step of axially sliding a tapered cylinder between the mandrel and the sleeve until the radially expandable portion of the sleeve expands until the at least one edge of the at least one ring engages the inside surface of the outer tubular.

28. A method of anchoring and/or sealing against an inside surface of an outer tubular in a well bore, the method comprising the steps of:

(a) running a mandrel with a sleeve thereon into the outer tubular to a desired location, the sleeve having a radially expandable portion with at least one separate ring generally concentrically disposed about the radially expandable portion;

(b) radially expanding the radially expandable portion of the sleeve whereby the at least one ring radially expands without appreciable deformation until the at least one ring engages the inside surface of the outer tubular to seal and/or anchor against the inside surface of the outer tubular, wherein the at least one ring comprises a seal slip ring that is continuous with at least one undulation in the axial direction that flattens upon radial expansion of the ring and that engages the inside surface of the outer tubular upon radial expansion to anchor the sleeve relative to the outer tubular.

29. A method of anchoring and/or sealing against an inside surface of an outer tubular in a well bore, the method comprising the steps of:

(a) running a mandrel with a sleeve thereon into the outer tubular to a desired location, the sleeve having a radially expandable portion with at least one separate ring generally concentrically disposed about the radially expandable portion;

(b) radially expanding the radially expandable portion of the sleeve whereby the at least one ring radially expands without appreciable deformation until the at least one ring engages the inside surface of the outer tubular to seal and/or anchor against the inside surface of the outer tubular, wherein the at least one ring comprises a seal ring that is continuous with at least one undulation in the axial direction that flattens upon radial expansion of the ring and wherein the seal ring is wavy in the axial direction to create a plurality of the undulations.

30. A packer comprising a mandrel about which a metal sleeve is concentrically disposed, the sleeve initially in a running position such that the mandrel and sleeve and be run into the outer tubular, the sleeve inflatable radially outward to a set position in response to a predetermined level of pressurization between the mandrel and the sleeve, the sleeve having at least one circular line of substantially sealing contact with the inside surface of the outer tubular when the sleeve is in the set position, wherein the sleeve has an inside surface spaced from the mandrel defining a chamber between the mandrel and the expandable portion of the sleeve, the chamber having a flowable material therein; and a piston slidably disposed about the mandrel and located about the chamber with a bottom end disposed in a reservoir in communication with the chamber, the piston slidable to increase the pressure in the chamber sufficiently to radially expand the expandable portion of the sleeve to the set position.

31. The apparatus of claim 30 wherein the flowable material is selected from the group consisting of rubber, polymers, oil, water and epoxy.

* * * * *